US006101771A

United States Patent [19]

Aikens

[11] Patent Number: 6,101,771

[45] Date of Patent: Aug. 15, 2000

[54] PANEL DOCK

[75] Inventor: Wallace R. Aikens, Plano, Tex.

[73] Assignee: Luminator L.P., Amherst, N.Y.

[21] Appl. No.: 09/131,986

[22] Filed: Aug. 11, 1998

[51] Int. Cl.[7] ..... E05D 7/00

[52] U.S. Cl. ..... 52/202; 52/204.62; 52/204.69

[58] Field of Search ..... 52/204.69, 204.65, 52/773, 767, 769, 202, 204.62

[56] References Cited

U.S. PATENT DOCUMENTS

| | | | |
|---|---|---|---|
| 729,148 | 5/1903 | Fabry | 52/204.66 |
| 2,217,997 | 10/1940 | Takach | 52/202 |
| 2,569,941 | 10/1951 | Matrangelo et al. | 52/202 |
| 2,716,783 | 9/1955 | Fegan | 52/202 |
| 2,744,346 | 5/1956 | Auerbach-Levy | 52/768 |
| 3,982,371 | 9/1976 | Preu | 52/498 |
| 4,349,993 | 9/1982 | Tanaka et al. | 52/208 |
| 4,470,231 | 9/1984 | Lewis | 52/204 |
| 4,680,915 | 7/1987 | Bush | 52/202 |
| 5,251,418 | 10/1993 | Jacobs et al. | 52/773 |
| 5,347,775 | 9/1994 | Santos | 52/202 |
| 5,413,397 | 5/1995 | Gold | 52/204.62 |
| 5,444,953 | 8/1995 | Koenig et al. | 52/773 |

*Primary Examiner*—Richard Chicot
*Attorney, Agent, or Firm*—Darby & Darby

[57] ABSTRACT

A system holds a panel in a held position adjacent to an opening, with the opening being defined by at least a first surface. The system includes a plurality of panel docks mounted on the at least first surface about the opening, with at least two of the panel docks being positioned on substantially diametrically opposite sides of the opening. Each of the panel docks includes: a base; an intermediate portion mounted on the base and having an aperture in which securing means is positioned to secure the base to the at least first surface adjacent to the opening; and an arm extending from the intermediate portion for applying a force to a respective portion of the panel to hold the respective portion between the arm and the at least first surface. The panels are secured by the panel docks to cover the opening without the need for fasteners or securing mechanisms directly engaging the panels and without the panel docks being visible.

6 Claims, 4 Drawing Sheets

PANEL DOCK

BACKGROUND OF THE INVENTION

1. Field of the Invention

This disclosure relates generally to the field of casings, and in particular to attachments to panels for covering fixtures and openings.

2. Description of Related Art

Access panels and other removable elements are typically secured to casings of appliances and fixtures using screws and other fasteners which directly engage the panels. For example, light fixtures may include translucent cover plates between an area to be lit and a light source such as a light bulb. Such cover plates may be used to diffuse, soften, or otherwise modulate the light from the light source. Other panels may include colored sheets of transparent and/or translucent materials which fit onto a light fixture or gobo assembly of a concert light to filter the illumination from the light source. In addition, components of the housings of computers, copying machines, and other appliances may be in the form of removable panels to be secured over access openings of such devices.

Heretofore, such panels have been directly secured by screws and other securing means, such as bolts, nails and fasteners engaging the panel at, for example, screw holes in the panel. Such configurations of panels and securing means require tools and effort to install and/or remove the securing means and so to install or remove the panels. A need exists for a mechanism for securing panels for easy installation or removal, for example, without the use of tools.

In addition, such securing means are typically visible; that is, the screws or bolts which mount the panels may be readily seen, which reduces the aesthetic appearance of the panel. For example, it may be desired to have a light fixture or a computer access panel having covers or panels which are flush with an outer housing or surface, and further which present a smooth surface. A need exists for a mechanism which is not visible as the mechanism secures a panel over an opening.

SUMMARY OF THE INVENTION

It is recognized herein that panels may be secured to cover openings without the need for fasteners or securing means engaging the panels and without being visible.

A system is provided for holding a panel adjacent to an opening in a held position, with the opening being defined by at least a first surface. The system includes a plurality of panel docks mounted on the at least first surface about the opening, with at least two of the panel docks being positioned on substantially diametrically opposite sides of the opening. Each of the panel docks includes: a base; an intermediate portion mounted on the base and having an aperture in which securing means is positioned to secure the base to the at least first surface adjacent to the opening; and an arm extending from the intermediate portion for applying a force to a respective portion of the panel to hold the respective portion between the arm and the at least first surface.

BRIEF DESCRIPTION OF THE DRAWINGS

The features and advantages of the disclosed panel dock and method of use are readily apparent and are to be understood by referring to the following detailed description of the preferred embodiments of the present invention, taken in conjunction with the accompanying drawings, in which.

DESCRIPTION OF THE PREFERRED EMBODIMENTS

Figure 1:
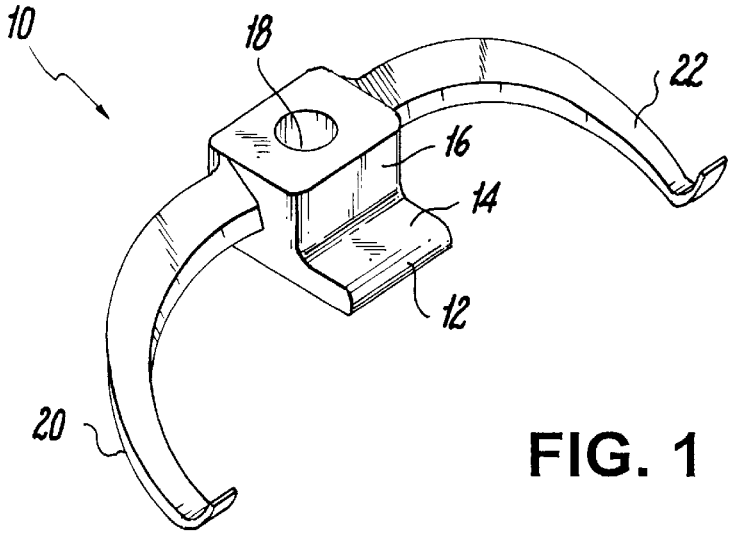
FIG. 1 illustrates the disclosed panel dock.

Referring in specific detail to the drawings, with common reference numbers identifying similar or identical elements, steps, and features, as shown in FIG. 1, the present disclosure describes a panel dock 10 and method of use for removably securing or docking panels and other components to openings without the need for fasteners or securing means and without being visible.

The term "panel" is herein defined to include any component, planar or otherwise, which is positioned to cover or otherwise obstruct an opening adjacent to a light fixture; an access port or region of a computer or other electronic devices; ceiling frames forming openings in which ceiling tiles are positioned; access openings in an airplane cabin component with the panel covering the access openings to mechanisms such as airline seat lights, vents, and call buttons as well as emergency oxygen masks and the like; an automobile dashboard opening to fuseboxes and automated automobile sensors and processors, etc. The panel may be oriented in any direction over, under, or laterally adjacent to the opening, and the panel is positioned to be substantially parallel to a plane defined by or tangential to the opening.

The panel dock 10 includes a base 12 or stop having a ride-over surface 14 on the base 12, an intermediate portion 16 having an aperture 18 therethrough, and at least one arm extending from the intermediate portion 16. The intermediate portion 16 may form a generally rectangular or annular cylindrical shape with the aperture 18 extending along a centrally located axis of the intermediate portion. Alternatively, at least a first surface of the intermediate portion 16 facing the base 12 may be planar to facilitate aligning a flat edge of a panel being positioned, as described herein. In a preferred embodiment, the at least one arm includes a pair of resilient arms 20, 22 extending from diametrically opposite sides of the intermediate portion 16.

Figure 2:
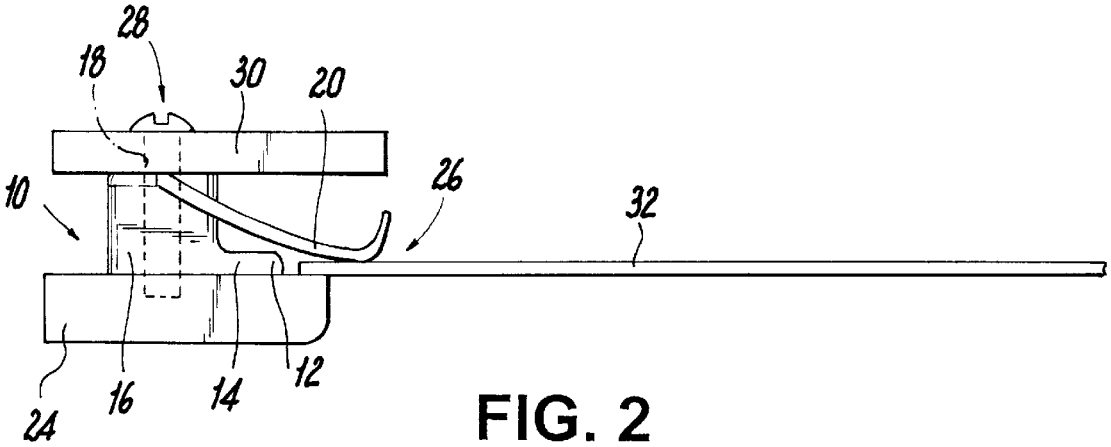
FIG. 2 illustrates a side view of the disclosed panel dock holding a panel.

As shown in FIG. 2, the panel dock 10 is mounted on a surface 24 which has an edge defining an opening. The panel dock 10 is mounted by securing means known in the art. In a preferred embodiment, the securing means is a screw 28 which extends into and through the aperture 18 of the panel dock 10 to securely engage the surface 24. The screw 28 may also extend into and through an aperture of a surface 30 of another component, such as a flange of a fixture, described in greater detail herein.

In a preferred embodiment, the panel dock 10 and screw 28 are mounted on the side of the surface 24 diametrically opposite to the outside or visible side of the surface 24, and so the panel dock 10 and screw 28 are not visible when a panel 32 is positioned as shown in FIG. 2.

As shown in FIG. 2 in a side view of the panel dock 10, the arms 20, 22 may be curved generally toward a plane through the base 12; that is, horizontally with respect to the view shown in FIG. 2. In particular, as shown in the perspective view in FIG. 1 and the side plan view in FIG. 2, the arms 20, 22 generally extend laterally with respect to the aperture 18, and curve downward slightly, as more clearly shown in FIG. 2. The ends 26, 34 of the arms 20, 22, respectively, may extend below a plane through the ride-over surface 14 of the base 12, and alternatively may extend below the base 12, provided that the arms 20, 22 have sufficient resilience to accommodate the panel 32 positioned between the arms 20, 22 and the surface 24.

The thickness of the panels 32 which may be held between the arms 20, 22 and the surface 24 is determined by the spacing between the ride-over surface 14 of the base 12 and the lowermost portions of the arms 20, 22, as well as the resilience of the arms 20, 22. Accordingly, various models of panel docks 10 having different specifications may have different panel thickness tolerances; that is, a particular panel dock may be specified as being able to function with panels less than a predetermined thickness. Otherwise, excessively thick panels may warp the arms 20, 22, and so may reduce the resilience or reduce the restorative force provided by the arms 20, 22 to the panel 32.

In a preferred embodiment, at least the arms 20, 22 of the panel dock 10 are composed of resilient material such as nylon and/or plastic substances. Alternatively, brass, stainless steel, aluminum, or other metals such as lightweight metals may also be used as the resilient material. For example, such metals may be configured as thin segments forming springs. The entire panel dock 10 may be composed of the same material as the arms 20, 22, and so the panel dock 10 and arms 20, 22 thereof may be fabricated as a monolithic, integrally-formed structure; for example, by injection molding.

Since the arms 20, 22 are resilient, the arms 20, 22 apply pressure to the panel 32 to secure the panel 32 between the arms 20, 22 and the surface 24. In particular, the panel 32 is removably secured, as described in greater detail herein.

As shown in FIG. 2, the base 12 and the arms 20, 22 extend away from the intermediate portion 16 in a horizontal direction (relative to the view shown in FIG. 2). In a preferred embodiment, the arms 20, 22 extend generally beyond the horizontal extent of the base 12, which permits the panel 32 to rest against the surface 24 between the edge and the base 12.

Figure 3:
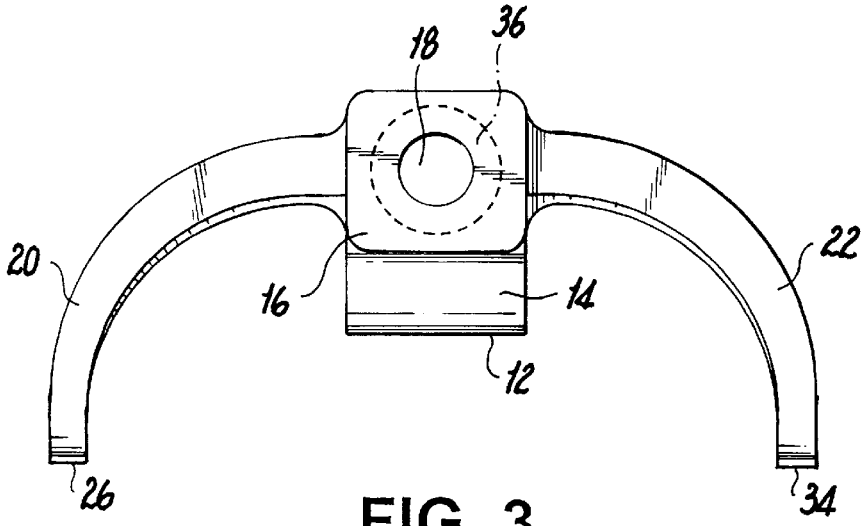
FIG. 3 illustrates a top view of the disclosed panel dock.

Referring to FIGS. 2–3, the ends of each of the arms 20, 22 may have a tip or foot; that is, a curved portion 26, 34, respectively. Only the arm 20 and curved portion 26 are visible in FIG. 2, but it is to be understood that the arm 22 and curved portion 34 thereof are also provided. The curved portion 26 projects a curved surface to contact the panel 32 in order to facility insertion and removal of the panel 32 between the arms 20, 22 and the surface 24, as described in greater detail herein.

A top view of the panel dock 10 is shown in FIG. 3, in which the arms 20, 22 are curved, for example, in a circular arc in a C-shape. The panel dock 10 may include an annular indentation 36 (shown in dashed lines) on the underside thereof and oriented to face the surface 24. The indentation 36 is concentric with the aperture 18 to permit a washer and/or a securing nut to be positioned in the indentation 36 between the panel dock 10 and the surface 24. In an alternative embodiment, the panel dock 10 may have a similar annular indentation on the top surface and concentric with the aperture 18 to allow the head of the screw 28 and/or a washer to be disposed in and flush with such an indentation.

Figure 4:
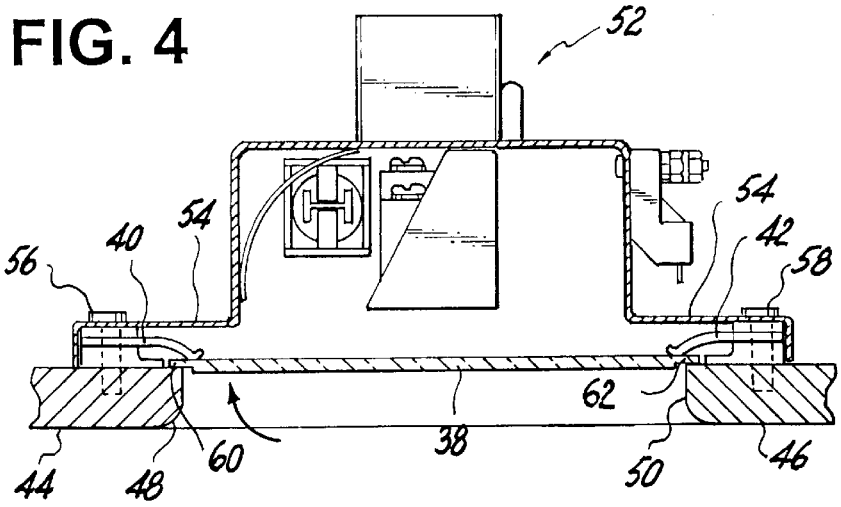
FIGS. 4–6 illustrate a step-by-step removal of a panel from a pair of panel docks.
Figure 5:
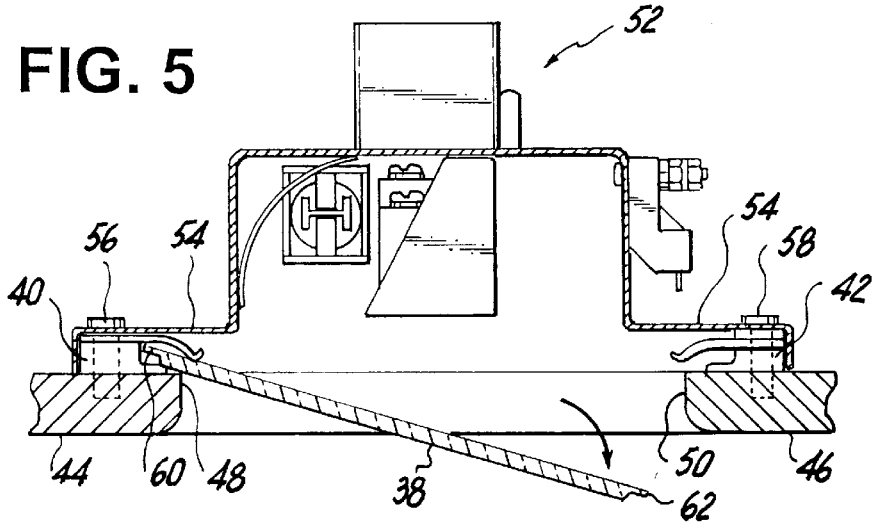
Figure 6:
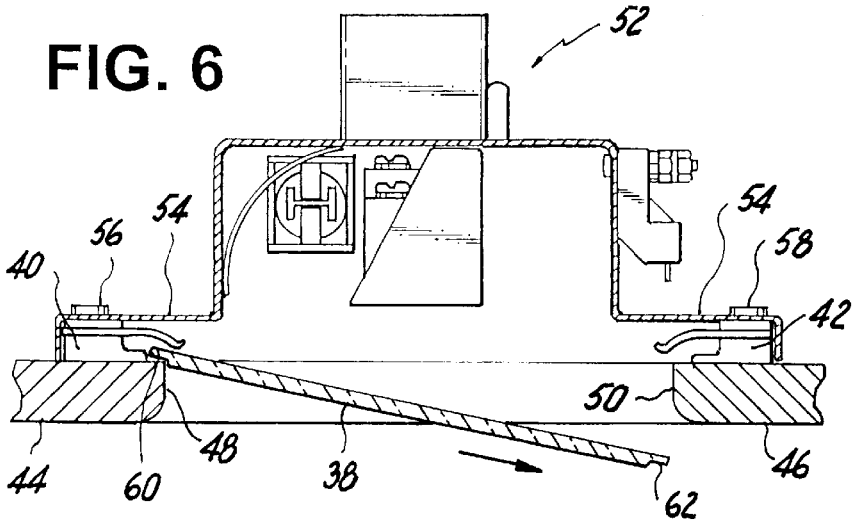

Referring to FIGS. 4–6, the removal of a panel 38 from a set of panel docks 40, 42 is progressively illustrated. As shown in FIGS. 4–6, the panel 38 is positioned between the arms of the panel docks 40, 42 and the surfaces 44, 46, respectively. The edges 48, 50 of the surfaces 44, 46, respectively, define the opening or access port through which other components such as a fixture 52 or computer components may be viewed and accessed.

It is to be understood that the surfaces 44, 46 may be portions of a common surface, and also that the edges 48, 50 may be portions of a common peripheral edge of the opening. In addition, although two panel docks 40, 42 are shown in the side cross-sectional views of FIGS. 4–6, it is to be understood that more than two panel docks may be used; for example, three or more may be arrayed around the periphery of the opening. Accordingly, a rectangular-shaped opening such as openings in fixtures for florescent lighting may use four panel docks, with one panel dock for each side of the opening. Similarly, a circular opening for cylindrically-shaped lighting fixtures may have four panel docks, with one panel dock for each quadrant. In addition, multiple panel docks may be used for each portion of a panel, such as on the same side of a panel, to provide greater pressure to each panel edge to removably secure the panel in place.

As shown in FIGS. 4–6, the panel docks 40, 42 are positioned such that a person viewing the panel 38 and the surfaces 44, 46 from below, relative to the vertically-oriented side views shown in FIGS. 4–6, does not see the panel docks 40, 42, and so the panel 38 and surfaces 44, 46 are more aesthetically pleasing.

The panel 38 may be transparent or translucent to transmit illumination from a light source in the light fixture 52. In an illustrative embodiment, the light fixture 52 is mounted to the surfaces 44, 46 by a frame 54 using screws 56, 58, respectively. To facilitate placement of the fixture 52 relative to the panel docks 40, 42, the screws 56, 58 may secure portions of the frame 54 to respective panel docks 40, 42 and thence to the respective surfaces 44, 46. In alternative embodiments, the panel docks 40, 42 may be integrally-formed portions of the frame 54 and/or the light fixture 52. For example, such a frame 54 may be provided by fusing panel docks 40, 42 to the frame 54, or alternatively by fabricating the frame 54 and the panel docks 40, 42 from a common material, such that the arms of the panel docks 40, 42 are resilient.

As shown in FIGS. 4–6, the panel 38 is removed by sliding the panel 38 towards one of the panel docks, such as panel dock 40, and also lifting a portion of the panel 38 near the panel dock 40 to overcome the downward restorative force of the arms 20, 22 of the panel dock 40 on the panel 38. Such horizontal and vertical motion of the panel 38, as illustrated by the arrow shown in FIG. 4, causes an end 60 of the panel 38 to enter the region between the arms 20, 22 and the ride-over surface 14 of the panel dock 40, as shown in FIG. 5. In addition, an opposite end 62 of the panel 38 disengages at least one other panel dock such as the panel dock 42, such that the opposite end 62 does not engage the surface 46 and the edge 50.

The panel 38 may then be pivoted downward, as shown by the arrow in FIG. 5, about an axis generally located near the end 60, with the axis extending horizontally out of the view shown in FIG. 5. The opposite end 62 then clears the edge 50 of the opening, which permits the panel 38 to be withdrawn from the panel dock 40, as shown by the arrow in FIG. 6, to be removed completely from the opening of the surfaces 44, 46.

For multiple panel docks configured around the periphery of an opening and holding a panel 38 in place, the removal procedure shown in FIGS. 4–6 may be extended such that the panel 38 is moved toward a portion of the panel docks, and thus away from the remaining portion of the panel docks to thus be freed from the remaining panel docks. The panel 38 is then pivoted out of the opening and removed from the original portion of the panel docks. Accordingly, the use of such panel docks facilitates removal of such panels without the need for tools.

Similarly, insertion of a panel into an opening, such at the panel 38 into the opening between surfaces 44, 46 of FIGS. 4–6, is readily performed by reversing the steps shown in FIGS. 4–6. That is, an end 60 is inserted between the arms and the base of a first panel dock 40, as shown in FIG. 6, in a direction counter to the arrow in FIG. 6. The panel 38 is pivoted upward to pass the end 62 into the opening, in a direction counter to the arrow in FIG. 5. The panel 38 is then slid to have the end 62 engage the panel dock 42, in a direction counter to the arrow in FIG. 4, to secure the panel 38 in the panel docks 40, 42 in the position shown in FIG. 4.

Referring to FIGS. 4–6, the insertion and removal of the panel 38 from the panel docks 40, 42 is facilitated by the upwardly curved portions of the arms of the panel docks. An inner curved portion of the arms directed toward the intermediate portion of each of the panel docks 40, 42 facilitates removal of the ends of the panel from the region between the base and the arms of the panel docks, since the curved surfaces do not obstruct release of the ends. Similarly, the curved portions of the arms facing away from the intermediate portion allow the ends of the panel to part the arms away from the base, and so to allow insertion of the ends into the panel dock, as shown in FIG. 6 for movement of the panel 38 in the opposite direction of the arrow.

Figure 7:
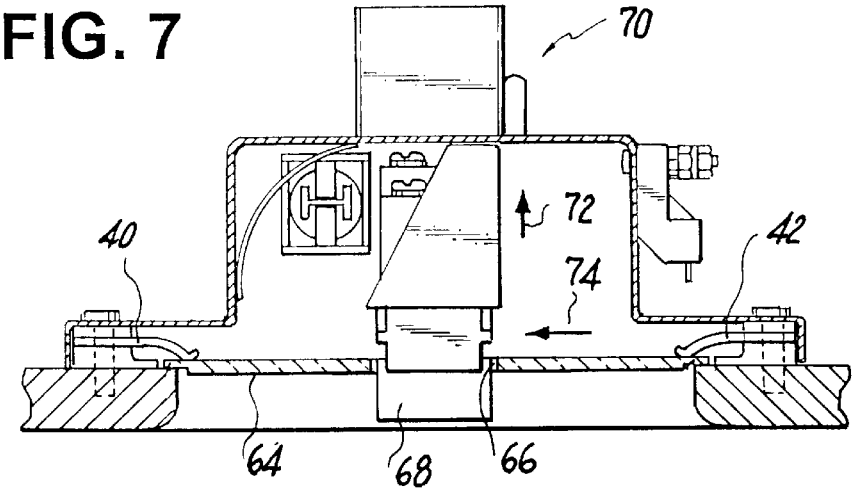
FIGS. 7–9 illustrate an alternative embodiment of a step-by-step removal of a panel from a pair of panel docks and a retractable portion of a fixture.
Figure 8:
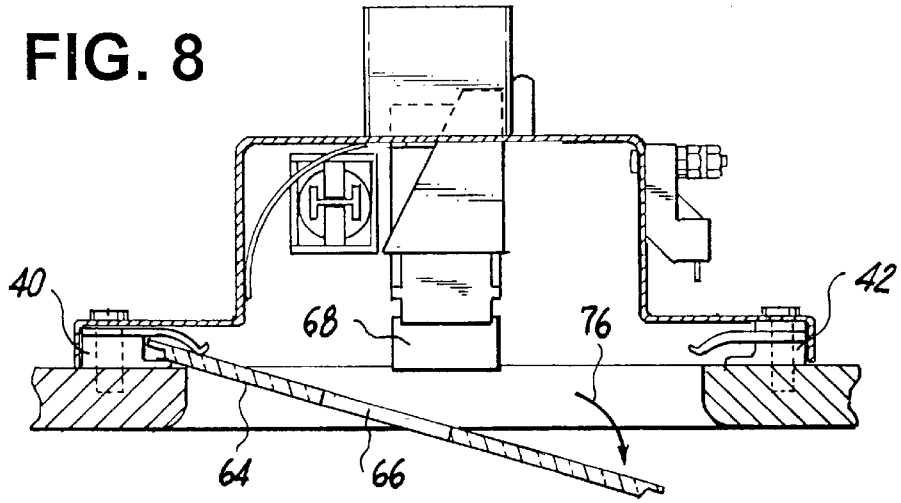
Figure 9:
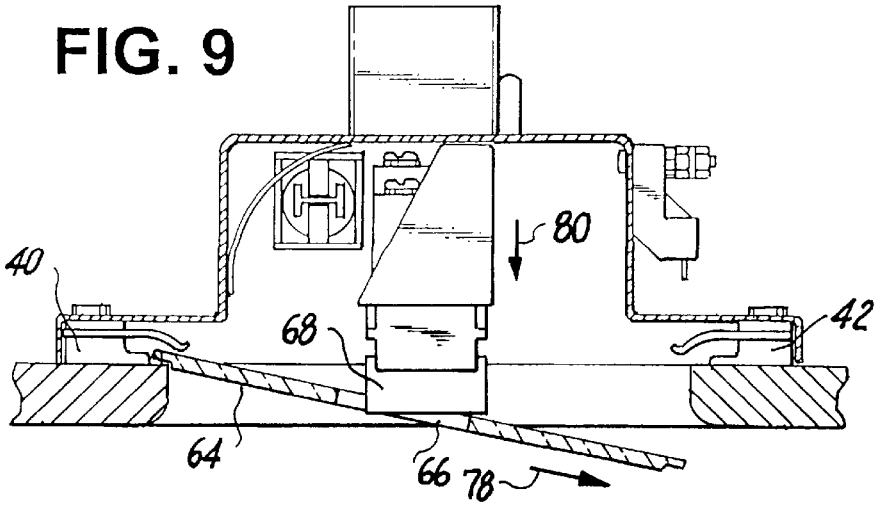

In an alternative embodiment shown in FIGS. 7–9, the removal and/or insertion procedure may be modified to accommodate elements extending through the panel. As shown in FIGS. 7–9, a panel 64 includes an aperture 66 through which a portion 68 of components 70 extends. For example, the portion 68 may be an opening for a pull-string or pull-chain of a light switch, in which the components 70 constitute an overhead light fixture. Alternatively, the portion 68 may be a rotatable knob or an activation button such as a power toggle switch for a power system as the components 70 of a computer, with the panel 64 being opaque to obscure the power system and other computer components 70 except the activation button or knob.

As shown in FIGS. 7, the panel 64 is removed by retracting or otherwise moving the portion 68 in the direction of the arrow 72, in order to displace the portion 68 from the aperture 66 to facilitate removal of the panel 64 from the opening. With the portion 68 displaced, as shown in FIG. 8, the panel 64 may be removed in the same manner described with reference to FIGS. 4–6. That is, the panel 64 is sequentially moved in the direction of the arrows 74–78 in FIGS. 7–9 to remove the panel 64 from the panel docks 40, 42. The portion 68 may optionally be restored to an initial position by moving the portion 68 in the direction of the arrow 80 in FIG. 9.

The insertion or re-insertion of the panel 64 may be performed by reversing the steps shown in FIGS. 7–9, in which the portion 68 is moved in a direction opposite to the arrow 80, and the panel 64 is inserted into the opening to engage the panel docks 40, 42 by sequentially moving the panel 64 in the directions opposite to the arrows 78, 76, and 74, as shown in FIGS. 9, 8, and 7, respectively. The portion 68 may then be displaced in a direction opposite to the arrow 72 in FIG. 7.

Figure 10:
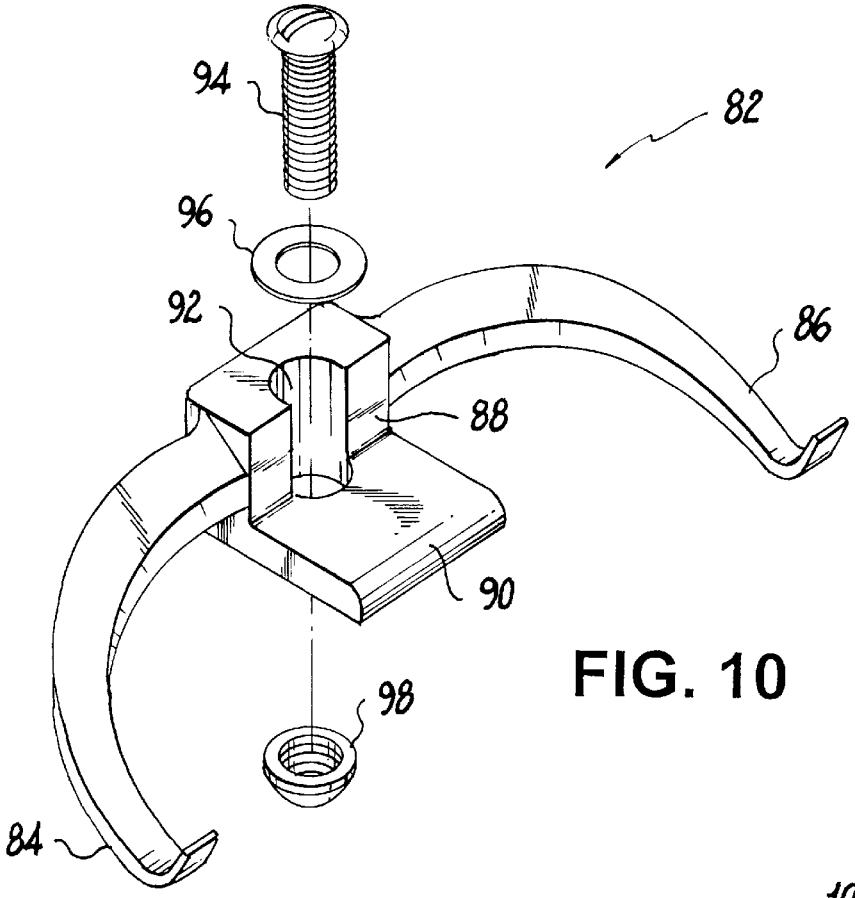
FIG. 10 illustrates an alternative embodiment of a panel dock.

In an alternative embodiment shown in FIG. 10, the panel dock 82 may have arms 84, 86 having a different shape than the arms 20, 22 shown in FIGS. 1–3. For example, the arms 84, 86 may be configured in an S-shape to provide a larger contact area with a panel at the ends of the arms 84, 86, and so to provide greater pressure over a greater area of the panel to maintain the panel in place.

In another alternative embodiment shown in FIG. 10, the intermediate portion of the panel dock 82 may be a portion of an annular cylindrical structure, such as a rectangular element 88 extending from the base 90 and having a flat surface (except for the aperture 92) for aligning a panel. Such an element 88 provides the aperture 92 for positioning securing means such as a screw 94 as well as a washer 96. Another element 98 may be disposed under the panel dock 82 and/or under a surface upon which the panel dock 82 is positioned. The element 98 may be a washer and/or a securing nut. The rectangular element 88 may be advantageous since less material may be required in the fabrication of each panel dock 82. Accordingly, the production of many thousands of such panel docks may save a significant amount of material.

Figure 11:
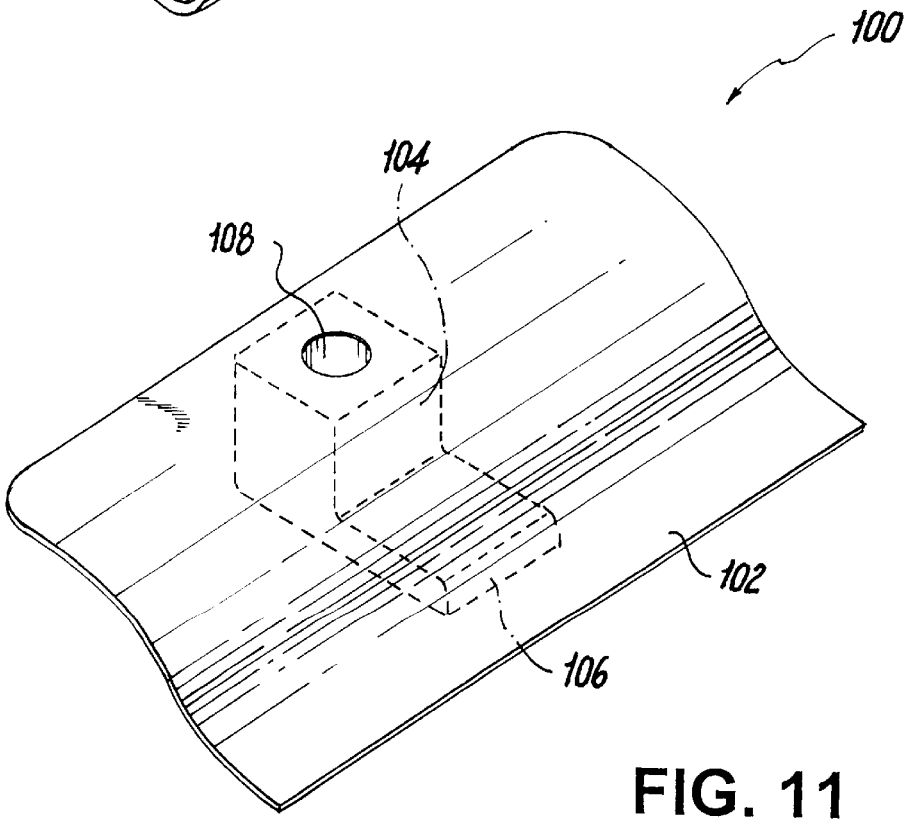
FIG. 11 illustrates another alternative embodiment of a panel dock.

In another alternative embodiment shown in FIG. 11, instead of arms such as the arms 20, 22 and the arms 84, 86 in FIGS. 1 and 10, respectively, a panel dock 100 may have a single resilient arm 102 which extends from an intermediate portion 104 on a base 106. The single resilient arm 102 may form a leaf-like sheet of resilient material. The intermediate portion 104 includes an aperture 108 for positioning securing means such as a screw, as described for the embodiments shown in FIGS. 1–10.

In the alternative embodiment of FIG. 11, the panel dock 100 provides greater contact between the resilient arm 102 and a panel such as the panel 38 shown in FIG. 4, and so may provide greater stability in holding the panel 38 in place. Since the resilient arm 102 may be formed from a single piece of resilient material such as nylon or plastic, the resilient arm 102 may be attached and/or fused to the intermediate portion 104. Alternatively, the resilient arm 102 and the intermediate portion 104 may be formed from a single mold such as by injection molding. With the resilient arm 102 formed as a single unit, the panel dock 100 may also be easier to fabricate without requiring precision to form specifically-shaped resilient arms.

While the disclosed panel dock and method of use are particularly shown and described herein with reference to the preferred embodiments, it is to be understood that various modifications in form and detail may be made without departing from the scope and spirit of the present invention. Accordingly, modifications such as any examples suggested herein, but not limited thereto, are to be considered within the scope of the present invention.

What is claimed is:

1. A panel dock comprising:

a base;

an intermediate portion mounted on the base and having an aperture in which securing means is positioned to secure the base to a first surface adjacent to an opening; and an arm extending from the intermediate portion for applying a force to a portion of a panel to hold the portion between the arm and the first surface wherein the arm includes:

a pair of curved arms extending in diametrically opposite directions from the intermediate portion, and curving toward the panel to hold respective portions of the panel between the respective arms and the first surface.

2. A system for holding a panel in a held position adjacent to an opening, with the opening being defined by at least a first surface, the system comprising:

a plurality of panel docks mounted on the at least first surface about the opening, with at least two of the panel docks being positioned on substantially diametrically opposite sides of the opening;

wherein each of the panel docks includes:

a base;

an intermediate portion mounted on the base and having an aperture in which securing means is positioned to secure the base to the at least first surface adjacent to the opening; and an arm extending from the intermediate portion for applying a force to a respective portion of the panel to hold the respective portion between the arm and the at least first surface; and wherein the each of the panel docks is configured so as to be capable of engaging the panel in a held position by inserting a first portion of the panel into the opening to engage a first arm of a first panel dock, by rotating at least a second portion of the panel into the opening, and by sliding the panel to have at least the second portion of the panel engage at least a second arm of a second panel dock, thereby positioning the panel into the held position engaging at least the first and second arms of at least the first and second panel docks, respectively.

3. The system of claim 2, wherein each of the panel docks is further configured so as to be capable of being disengagable from said held position and from said opening by sliding the panel to have at least the second portion of the panel disengage at least the second arm of the second panel dock, by rotating at least the second portion of the panel out of the opening, and by removing the first portion of the panel out of the opening to disengage the first arm of the first panel dock.

4. A system for holding a panel in a held position adjacent to an opening, with the opening being defined by at least a first surface, the system comprising:

a plurality of panel docks mounted on the at least first surface about the opening, with at least two of the panel docks being positioned on substantially diametrically opposite sides of the opening; and wherein each of the panel docks includes:

a base;

an intermediate portion mounted on the base and having an aperture in which securing means is positioned to secure the base to the at least first surface adjacent to the opening;

at least one arm composed of resilient material extending from the intermediate portion for applying a force to a respective portion of the panel to hold the respective portion between the at least one arm and the at least first surface, wherein the force from the resilient at least one arm is a restorative force for holding the portion of the panel;

a curved tip on each at least one arm, responsive to the first portion engaging the curved tip, for countering the restorative force; and a ride-over surface on the base and defining a space between the base and a first of the at least one arm to allow the first portion to be positioned between the first arm and the ride-over surface during insertion of the first portion into the first panel dock.

5. A method for holding a panel in a held position adjacent to an opening, with the opening being defined by at least a first surface, the method comprising the steps of:

providing a plurality of panel docks mounted on the at least first surface about the opening, with at least two of the panel docks being positioned on substantially diametrically opposite sides of the opening, wherein each of the panel docks includes:

a base;

an intermediate portion mounted on the base and having an aperture in which securing means is positioned to secure the base to the at least first surface adjacent to the opening; and an arm extending from the intermediate portion for applying a force to a respective portion of the panel to hold the respective portion between the arm and the at least first surface;

inserting a first portion of the panel into the opening to engage a first arm of a first panel dock;

rotating at least a second portion of the panel into the opening; and sliding the panel to have at least the second portion of the panel engage at least a second arm of a second panel dock, thereby positioning the panel into the held position engaging at least the first and second arms of at least the first and second panel docks.

6. The method of claim 5, further comprising the step of removing the panel from the held position and from the opening, including the steps of:

sliding the panel to have at least the second portion of the panel disengage at least the second arm of the second panel dock;

rotating at least the second portion of the panel out of the opening; and removing the first portion of the panel out of the opening to disengage the first arm of the first panel dock.

* * * * *